US005560551A

United States Patent [19]

Suverkrop

[11] Patent Number: 5,560,551

[45] Date of Patent: Oct. 1, 1996

[54] HIGH SPEED SKIP HOIST SYSTEM

[76] Inventor: Don Suverkrop, 3513 Century Dr., Bakersfield, Calif. 93306-1238

[21] Appl. No.: 233,594

[22] Filed: Apr. 25, 1994

[51] Int. Cl.[6] ..... B02C 21/02

[52] U.S. Cl. ..... 241/34; 241/101.74; 241/101.742; 241/186.4

[58] Field of Search ..... 241/34, 186.4, 241/101.742, 101.763, 101.74

[56] References Cited

U.S. PATENT DOCUMENTS

| | | | |
|---|---|---|---|
| 4,666,091 | 5/1987 | von der Heide | 241/101.7 |
| 4,909,449 | 3/1990 | Etheridge | 241/34 |
| 4,911,215 | 3/1990 | Phipps | 144/337 |
| 4,961,539 | 10/1990 | Deem | 241/36 |
| 5,074,435 | 12/1991 | Suverkrop et al. | 222/55 |
| 5,205,496 | 4/1993 | O'Donnell et al. | 241/34 |
| 5,226,757 | 7/1993 | Tarrant | 406/39 |
| 5,452,861 | 9/1995 | Faccia | 241/101.72 |

*Primary Examiner*—John Husar

*Attorney, Agent, or Firm*—Fulwider, Patton, Lee & Utecht, LLP

[57] ABSTRACT

A high speed skip hoist handles heavy payloads, such as bulk solids, and includes a bucket for handling the bulk material and a control system which regulates the acceleration and deceleration of the payload as it moves between a first position to a second position through substantially pure rotational motion. The control system may utilize hydraulic cylinders to move the payload through its substantially rotational motion and pumps for controlling the amount of hydraulic fluid being pumped to the hydraulic cylinder to control acceleration and deceleration of the payload as it moves between the first and second position.

16 Claims, 4 Drawing Sheets

12
14
16
P3
P2
10
23
22
24
32
38
30
40
P1
26
44
28
18
20

30
42
42
42
42
34
41
38
40
32
24

HIGH SPEED SKIP HOIST SYSTEM

BACKGROUND OF THE INVENTION

1. Field of the Invention

The present invention relates generally to heavy duty machinery used to haul materials from one location to another and, more particularly, to a high speed skip hoist system designed for elevating a heavy payload comprising bulk solids that may include some amount of large particle size from an initial position to an elevated position while accurately controlling the acceleration and deceleration of the payload throughout the lift stroke. The system controls the speed of the payload to reduce the generation of unwanted force moments during the lift and return strokes of the hoist, which is basically pure rotational motion, thus eliminating the need to apply additional braking forces in order to stop the momentum of the payload as it approaches the terminal position at each end of the cylinder strokes.

2. Description of Related Art

Stationary and mobile in-pit processing plants have been utilized in the mining industry for years since such plants are capable of on-site processing of bulk materials which have been excavated or blasted from the working face of a quarry, pit or mine. The use of mobile plants in the mining industry is particularly useful since such plants can be readily transported within the pit or quarry to follow the progress of the mining operation.

A typical stationary or mobile in-pit processing plant generally includes a primary crusher which processes the first stage of the material reduction at the work site. The primary crushing station includes rock crushing machinery which crushes the bulk materials into a more manageable size. The crushed materials can then be either hauled away or further processed by secondary stations.

Haulage costs of the materials to be processed can often be quite large in an open pit mining operation. Generally, quarry trucks and front end loaders (usually wheel loaders) have been used for hauling the bulk materials to the on-site crushing plants or other locations, but they are labor intensive, use a costly energy source and can be a somewhat expensive means for hauling bulk materials for processing. The popularity of using these vehicles for long distance haulage has been largely due to the limited mobility of the crushing station including the access ramp. As mining progresses, the haul distances can become quite long.

The use of belt conveyors in open pit mining operations has become increasingly popular since conveyors are relatively less expensive to operate and numerous conveyors can be connected together to haul material for distances of several miles. One of the prohibitions to their greater use relates generally to the difficulty of feeding the belt system with a steady stream of properly-sized material to prevent uneven feed rates which could be detrimental to the power source since unwanted surges could be generated which would strain the power source. An uneven feed rate could also cause materials to overflow from the conveyor which could cause damage to the conveyor itself, along with any machinery or personnel within the vicinity of the belt conveyor. It is not uncommon for rocks to fall off conveyor systems at open pit mining operation and land on personnel, resulting in injury, and in some cases, death.

Therefore, in order to effectively utilize belt conveyors, the maximum size of the material must be carried on the conveyor should be limited to approximately a 12 inch or so dimension, otherwise the above-noted problems may persist. In order to reduce material that is larger than 12 inches, primary crushing would be required.

There is also a need to maximize the efficiency of the use of belt conveyors at the job site to conserve energy and possibly avoid the use of trucks entirely. In this manner, it has been suggested that the crushing be as near to the working face of the mine as possible, with the crusher ideally receiving the bulk material from the excavator or front end loader at the face of the pit to allow the crushed materials to be discharged directly onto a conveyor belt where it can be conveniently transported to other processing stations for secondary operations, or simply sent to a remote location for storage or use.

Some of the shortcomings of a typical primary crushing stations were addressed by my invention described in U.S. Pat. No. 5,074,435, which is directed to a system for controlling the feed rate of a vibrating feeder at the primary crushing station which allows a steady stream of crushed material to be processed by the primary crushing station. That particular invention provided a system for automatically controlling the feed rate of the materials being processed and discharged from the primary crusher unit to allow for the implementation of belt systems for processing and hauling of the processed materials from the primary crushing unit to secondary stations or locations.

While the direct benefits of utilizing a primary crushing plant at the working face of an open pit operation has been recognized, certain problems sometimes exist, such as properly feeding bulk materials to the crusher plant in a timely and cost effective manner. Front end loaders are being increasingly used as excavators. Unfortunately, most front end loaders have a limited lift reach and can not directly feed the large primary crushing station without the use of earthen ramps or other devices which elevate the front end loader allowing it to dump its payload directly into the hopper or feeder of the primary crushing station. As a result, additional time and space must be dedicated for the construction of such ramps and the ramps must be continually moved whenever the primary crushing station is moved. Additionally, more time may be needed to move the front end loader up and down these ramps. These shortcomings, attributable to the rather large size of the crushing station and the limited lift height of the front end loader, ultimately add to the cost and effectiveness of hauling bulk material to the primary crushing station.

Some attempts have been made to avoid the above-noted problems in feeding the primary crushing station by including a conveyor unit to elevate the bulk material to the hopper of the crusher, thus eliminating the need for front end loaders to place the material directly into the hopper. However, the sensitivity of these conveyor units to damage caused from large stones and the weight of the bulk material can be extensive and could result in increased expenses in maintaining the conveyor unit.

As a result of the shortcomings associated with primary crushing units which have a high overhead hopper, there is a need for a system for overcoming the height problem such that the crushing station can be used in combination with front end loaders to feed the bulk materials to the crushing station while still enabling the station to operate at its optimum speed. Therefore, there is a need for a system which can be either attached to the primary crushing station or easily placed next to the station which continuously feeds bulk material for crushing and can be easily moved with the station as may be needed.

SUMMARY OF THE INVENTION

The present invention provides a hydraulically powered, high speed skip hoist system designed to elevate a substantially heavy payload between a first position to a second elevated position through substantially pure rotational motion. The present invention moves the payload (usually bulk solids held in a receiving bucket) to the elevated position while carefully controlling the acceleration and deceleration of the payload throughout the lifting motion. The present invention utilizes structural means for elevating the payload which includes at least one hydraulic cylinder having a lifting stroke which supplies the primary lifting power to the skip hoist system. The hydraulic cylinder has a lifting stroke which moves the payload from an initial position (usually a nine o'clock position) to a second elevated position (usually a twelve o'clock position).

The system includes pump means operatively connected with the hydraulic cylinder for actuating the cylinder. Control means are also operatively connected with the pump means to control the amount of fluid being pumped to the hydraulic cylinder to control the acceleration and the deceleration of the payload as it moves between the first and second positions. The control means actively controls the pump means and the speed of the payload as it moves to the second elevated position to reduce the generation of unwanted force moments on the skip hoist, thus reducing the need for additional mechanisms to provide external braking forces which would otherwise be needed to stop the momentum of the payload as it reaches the elevated position. The control means is designed to operate in relation to the lifting stroke of the hydraulic cylinder, i.e., as the hydraulic cylinder moves through the lifting stroke, the control means activates or deactivates certain pumps in the hydraulic system to supply more or less fluid to the hydraulic cylinder as needed, thus controlling the acceleration and deceleration of the payload.

The control system can utilize a cam and cam follower to activate electrical control switches which are responsive to the lifting stroke of the hydraulic cylinder. For example, a cam can be connected directly with the rod end of the hydraulic cylinder and a cam follower or roller could be placed in contact with the surface of the cam to activate the electrical control switches as the hydraulic cylinder moves through the lifting stroke. In this manner, the electrical system of the control system can activate or regulate the hydraulic pumps utilized in the hydraulic system of the present invention. In this manner, pumps can be turned on or off throughout the lifting stroke of the hydraulic cylinder as determined by the cam and cam roller.

The present invention also includes means for maintaining the payload substantially level throughout the rotational travel between the first and second positions to insure that the payload does not spill during travel. In one embodiment of the present invention, the means for moving the payload between the first and second elevated positions include a pair of lift arms pivotally attached to a base structure and a bucket which is designed to receive the payload. The hydraulic cylinder is also pivotally attached to the base and one of the lift arms. It is also possible to use a second hydraulic cylinder which could in turn be pivotally attached to the second lift arm of the assembly. An extendable link with a hydraulic cylinder could also be pivotally attached to the base and bucket for maintaining the bucket substantially level during the rotational travel. This extendable link could also be utilized to move the bucket into a third position which tilts the bucket to allow the contents therein to fall to a desired location.

In one form of the invention, the pump means includes a plurality of hydraulic pumps connected in series with the hydraulic cylinder and the control means regulates or activates each pump as required to supply the required amount of fluid being supplied to the hydraulic cylinder. Again, the control means is operative with the stroke of the hydraulic cylinder to regulate the flow of fluid being supplied to it. As the payload approaches the second elevated position, the fluid being pumped to the hydraulic cylinder is decreased thus allowing the payload to decelerate without the need for additional braking mechanisms which would otherwise be required to stop the momentum of the payload.

The features and advantages of the present invention will become apparent from the foregoing detailed description taken in conjunction with the accompanying drawings which illustrate by way of example the principle of the present invention.

DETAILED DESCRIPTION OF THE PREFERRED EMBODIMENTS

The present invention provides a novel hydraulically powered, high speed skip hoist system designed for elevating a heavy payload from a lower position to an elevated position while accurately controlling the acceleration and deceleration of the payload throughout the lift stroke. The system reduces unwanted force moments to be generated during the lift stroke of the hoist which could be detrimental to the system and reduces the need for external braking forces in order to stop the momentum of the payload as it approaches the elevated position near the end of the lift stroke.

Figure 1:
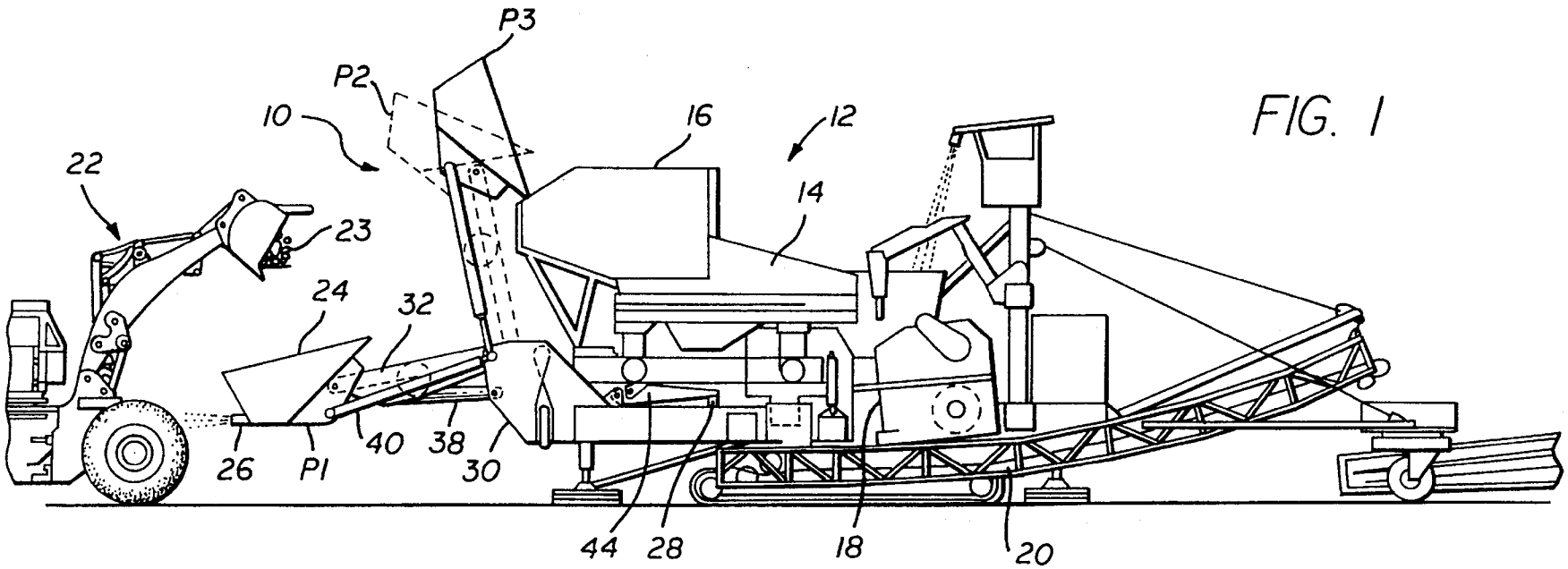
FIG. 1 is a side elevational view of the high speed skip hoist system made in accordance with the present invention as it is attached to a typical primary crushing station having a vibrating feeder, rock crushing machinery and take-away conveyor system.

FIG. 1 illustrates a general arrangement of the machinery which would constitute a typical hydraulically powered, high speed skip hoist system 10 as it would be attached to a typical primary crushing station 12. The primary crushing station 12 includes a representative embodiment of a vibrating feeder 14 utilized to receive raw material from a hopper 16. The primary crushing station includes a rock crushing assembly 18 which receives bulk materials to be crushed into smaller sized stones which are discharged onto a take-away conveyor unit 20. This take-away conveyor unit 20 can transport the processed materials to secondary conveyor systems or stations, or to a remote location.

A front end loader 22 feeds bulk material 23 into a bucket 24 which forms part of the skip hoist system 10. The skip hoist system 10 also includes a control system 25 (schematically shown in FIG. 6) which is utilized to control the movement of the skip hoist as it moves from an initial or first position P1 to the second elevated position P2. The skip hoist can also be moved to a third position P3, in which the bucket 24 is tilted to allow the bulk materials 23 to drop into the hopper unit 16 of the primary crushing station 12. The control system 25 includes a sensor 26, such as a sonic sensor or manual actuating means, located at the end of the bucket 24 for detecting the presence of the front end loader 22. This particular sensor provides an electrical signal to activate the control system to open the hydraulic circuits (described in greater detail below)to automatically start the lifting cycle of the skip hoist 10. A load cell 28, which can be included in the control system, is located beneath the hopper 16 in order to detect if the weight of the materials in the hopper is too great. In such a case, the operation of the control system will prevent additional materials from being loaded into the hopper 16 until the vibrating feeder 14 and rock crushing assembly 18 can process the materials already in the hopper. This particular load cell 28 provides a convenient means for detecting the presence of an excessive load in the primary crushing station to prevent an overflow of material into the hopper. The sensor 26 and load cell 28 are shown in the schematic diagram of the control system depicted in FIG. 6.

The skip hoist 10 is mounted to the end of the primary crushing unit by a base structure 30 which has a pair of lift arms 32 pivotally attached thereto for raising the bucket 24 from the first position P1 to the second elevated position P2. It should be appreciated that in the drawings of FIGS. 1 and 2, only one lift arm 32 is shown, however, there is an additional arm which is attached to the opposite end of the base for properly raising the bucket 24. Because the loading on the bucket 24 may create an eccentric load, torsional rigidity of the lift arms is required. For this reason, a cylindrical support structure 34 and anchor plate 36 (see FIG. 5) are attached to each of the lift arms for increasing the structural integrity of the lift arm assembly.

A main hydraulic cylinder 38 is also pivotally attached to the base 30 and the lift arm 32. This particular hydraulic cylinder provides the primary lifting power which is needed in order to raise the bucket 24 from the first position P1 to the second elevated position P2. A second hydraulic cylinder 38 could also be attached to the other lift arm 32 to help in the elevation of the payload during the lifting stroke. An extendible link 40 with a second hydraulic cylinder 41 is also attached to the base and the bucket to help level the bucket as it is moved from the first position P1 to the second position P2. This particular extendible link 40 with its hydraulic cylinder 41 also can be operated to move the bucket 24 from the second position P2 to the third position P3 to discharge the materials into the hopper unit 16. A second extendible link with hydraulic cylinder could also be attached to the other lift arm which is not shown in FIGS. 1 and 2. It should be appreciated that the hydraulic cylinders 38 and 41, along with the lift arms 32, are pivotally connected to the respcctive components using pivotal fasteners, such as pin joints 42.

Figure 2:
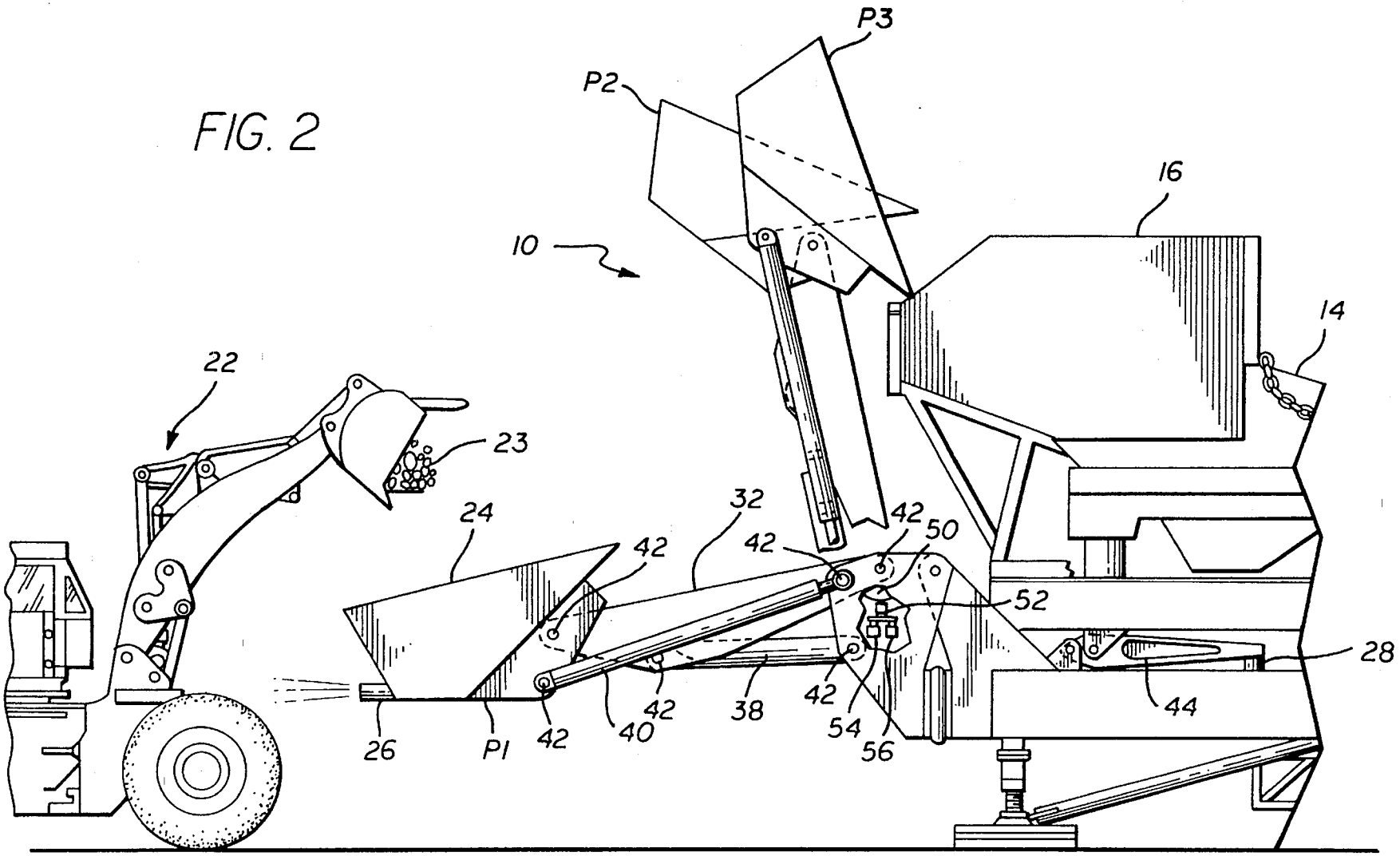
FIG. 2 is a side elevational view with portions of the components partially removed of the high speed skip hoist system shown in FIG. 1.

The bucket 24 is designed to carry material but is not designed nor intended to directly dig into a pile of material. That particular work is left to the front end loader 22 which collects the material from the working face of the quarry or pit for loading directly into the bucket 24. There is no digging edge on the bucket 24 as can be seen in the FIGS. 1 and 2 as it relies entirely on other vehicles, such as front end loaders, to do the filling. The bucket 24 may rest on the ground during filling or may be elevated some distance above it as is shown in FIGS. 1 and 2.

It is intended that after the front end loader dumps bulk material into the bucket 24, even if it is not fully loaded, the bucket 24 elevates the material from the first position P1 up to the elevated position P2 either automatically or by manual means, where the bucket could then be tilted into the third position P3 to drop the materials into the main hopper 16 of the primary crushing station. The bucket capacity of the front end loader can be quite heavy when fully loaded so it is desirable to have the system automatically cycle after each load is received in order to prevent the possibility of overload, structural damage or hydraulic failure in the event that the system is unable to lift a payload which is heavier than the designed capacity.

During the automatic cycle of the skip hoist system, the sensor 26 detects when the loader has backed away a sufficient distance. A limit switch detects that the loader bucket is clear, allowing the bucket 24 to be elevated to the second elevated position P2. It should be appreciated that in the particular form of the embodiment herein shown, a sensor 26 is utilized to detect the presence of the front end loader. However, any similar system could also be utilized in accordance with the present invention in order to activate the automatic cycling of the system.

Once the automatic cycle is activated, powering of the lift motion is accomplished primarily by the hydraulic cylinder 38 which in its extended mode causes the lift arms 32 to move the bucket 24 into the second elevated position P2. Again, the bucket is pivotally connected to the lift arm 32 via pins 42. When the lift arms 32 are in the second elevated position P2, the bucket remains there until the system determines if the hopper 16 is already full, since it may be dangerous to dump any more material into the hopper as there could be an overflow of large rocks and stones to the ground which can endanger personnel and machinery. The system 10 detects when the hopper is full utilizing the load cell 28 which measures the weight of the materials in the hopper. In the particular embodiment shown in FIGS. 1 and 2, the hopper 16 and its contents are carried on weigh beams 44 with the weight being sensed by the load cell 28. If the weight in the hopper exceeds a certain amount, movement of the bucket 24 from the second elevated position P2 to the third position P3 is prevented. If the weight in the hopper is less than a certain amount, the hydraulic cylinder 41 is activated, causing the bucket 24 to move into the third position P3. The bucket 24 remains in position P3 for a short period allowing the materials to drop directly into the hopper 16. The bucket is then returned to the first position P1 for another load.

The extendible link 40 forms a modified parallelogram in conjunction with the lift arm 32 such that when the bucket 24 is raised to the second elevated position P2, the bucket 24 is rotated slightly towards the dump position but moves insufficiently to dump any materials out of the bucket. If there is no signal to prevent dumping from the load cell 28, then the hydraulic cylinder of the extendable link 40 is actuated to cause the link to become longer thus moving the bucket into the third position P3. The return of the bucket 24 from position P3 to the first position P1 is performed with the retraction of the main hydraulic cylinders 38 and the extendable links 40.

The cycle of the skip hoist system is such that a demonstrated cycle time can be in the 25–30 second range.

Generally, a reasonable cycle time in loading trucks in the 25–30 second range would be a feasible rate at which to operate the primary crushing unit. A 30 second time cycle may be preferred for economic results; however, smaller machines may have a different requirement. Of course, if a longer time cycle is needed for cycling the bucket from the first position P1 through positions P2 and P3 and back to P1, then the control system can be adjusted to accommodate the required time interval. It should be recognized that the simplicity of the control system (described below and shown in FIG. 6) gives the user many alternatives in the timing of the automatic cycle of the hoist system.

While the present invention may appear to have a relatively simplistic approach in elevating the payload from the first position P1 to the second position P2 and third position P3, it must be remember that the bucket 24 may contain quite a heavy load of materials during the lifting stroke. When the design requirements were actually reviewed, it was recognized that acceleration and deceleration of such a payload from the position P1 to position P2 would require unusual performance on the part of the hydraulic system, along with the other components making up the high speed skip hoist system. As can be seen from FIGS. 1 and 2, the moment arm of the center of gravity of the bucket 24 about its pivot point on the base 30 drastically reduces from position P1 to the second position P2, yet at position P2, the bucket must be quickly de-accelerating due to the payload in the bucket. Since the momentum of the bucket as it moves upwards to the second position P2 can be quite substantial, a possible reversal of force moments could occur which would result in the need to apply external braking forces in order to stop the bucket 24 and prevent it from overshooting past position P2 into the hopper 16. If it were not for the control means utilized in the present invention, an external braking assembly would be required to properly stop the bucket and its contents as it moves upwards to the second elevated position P2. As a result of utilizing a system which accurately controls a series of pumps which supply the fluid flow to the hydraulic cylinder 38, it is possible to decelerate the payload of the bucket as it rises to the second elevated position P2, thus eliminating the need to apply additional braking forces.

The problem which was confronted in designing the present invention resulted since current technology relating to hydraulic systems could not provide on an economical basis the necessary components required to decelerate the payload as it approached the second elevated position P2. Current technology most commonly utilizes piston pumps which control volume based on pressure compensation. As pressure falls off in these devices, volume is increased, not decreased, to effect a constant power relationship. Since this appears to be the only control available for the larger pumps that would be needed to handle the loads contemplated in this present application, the current technology would not be suitable for use in the present invention. The problem which was faced in designing the present invention was that while it was recognized that pressure is falling off as the payload proceeds upwards to the second elevated position P2, there is a need to reduce, not increase, the flow to the hydraulic cylinders to effectively decelerate the payload. Such a system for controlling the fluid flow to the hydraulic cylinder is not currently available and is actually a reverse of what is commonly available commercially.

Figure 3:
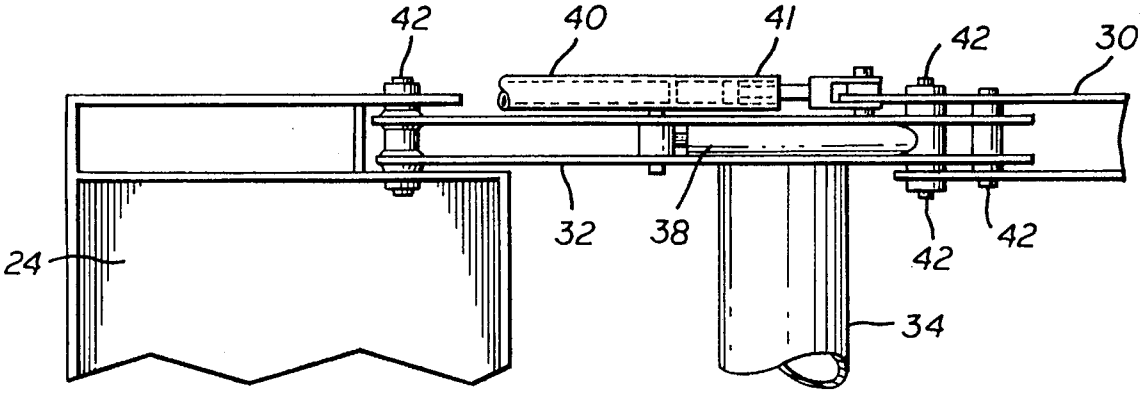
FIG. 3 is a partial plan view of the high speed skip hoist system shown in FIG. 2.

Referring now to FIG. 3, a partial plan view of the bucket 24 as it is attached to the lift arm 32 is shown. In this particular figure, the hydraulic cylinder 38 is also shown as it is pivotally attached to the base 30 and the lift arm 32 via the pins 42. The extendable link 40 with its hydraulic cylinder 41 is also shown as it is attached to the base 30 via a pin 42. The opposite end of the extendable link 40 would also be pivotally attached to the bucket utilizing a similar pin 42 (not shown). The cylindrical support structure 34 is also attached to the lift arm 32 for additional strength for the lift arm assembly.

Referring now to FIG. 4, the lift arm 32 is again shown as it is pivotally attached to the base plate 30. This base plate 30 is in turn connected to a plate 46 of the primary crushing station. The base 30 can be attached utilizing connector pins or other similar connecting means known in the art. A shock absorbing device 48 can be attached between the base 30 and plate 46 to absorb some of the shock which can be generated whenever the bucket is loaded with bulk materials.

Figure 4:
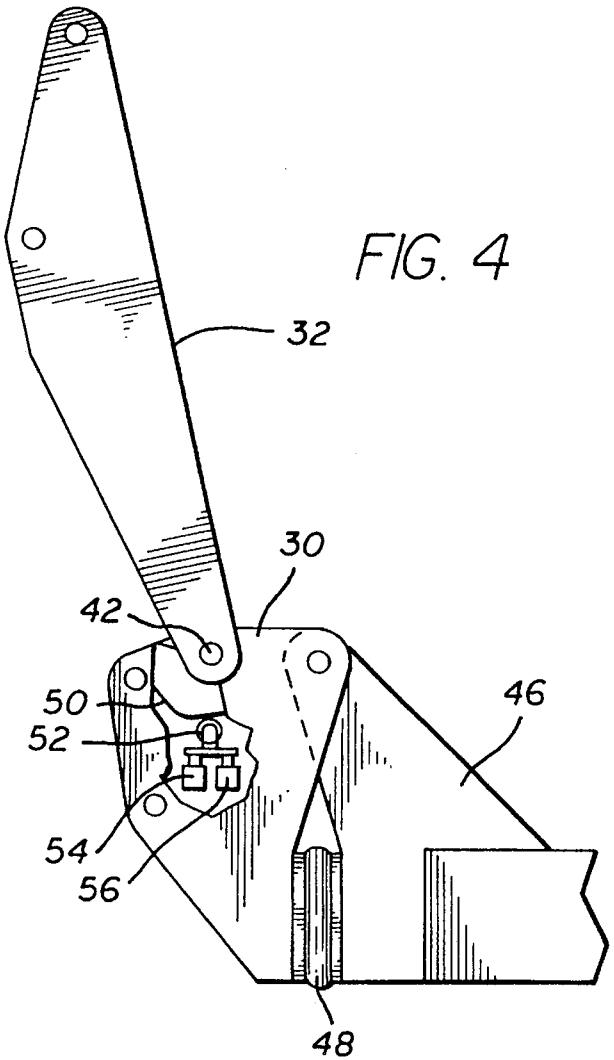
FIG. 4 is a side elevational view with portion of the components removed of the lift arm and a portion of the control system.
Figure 6:
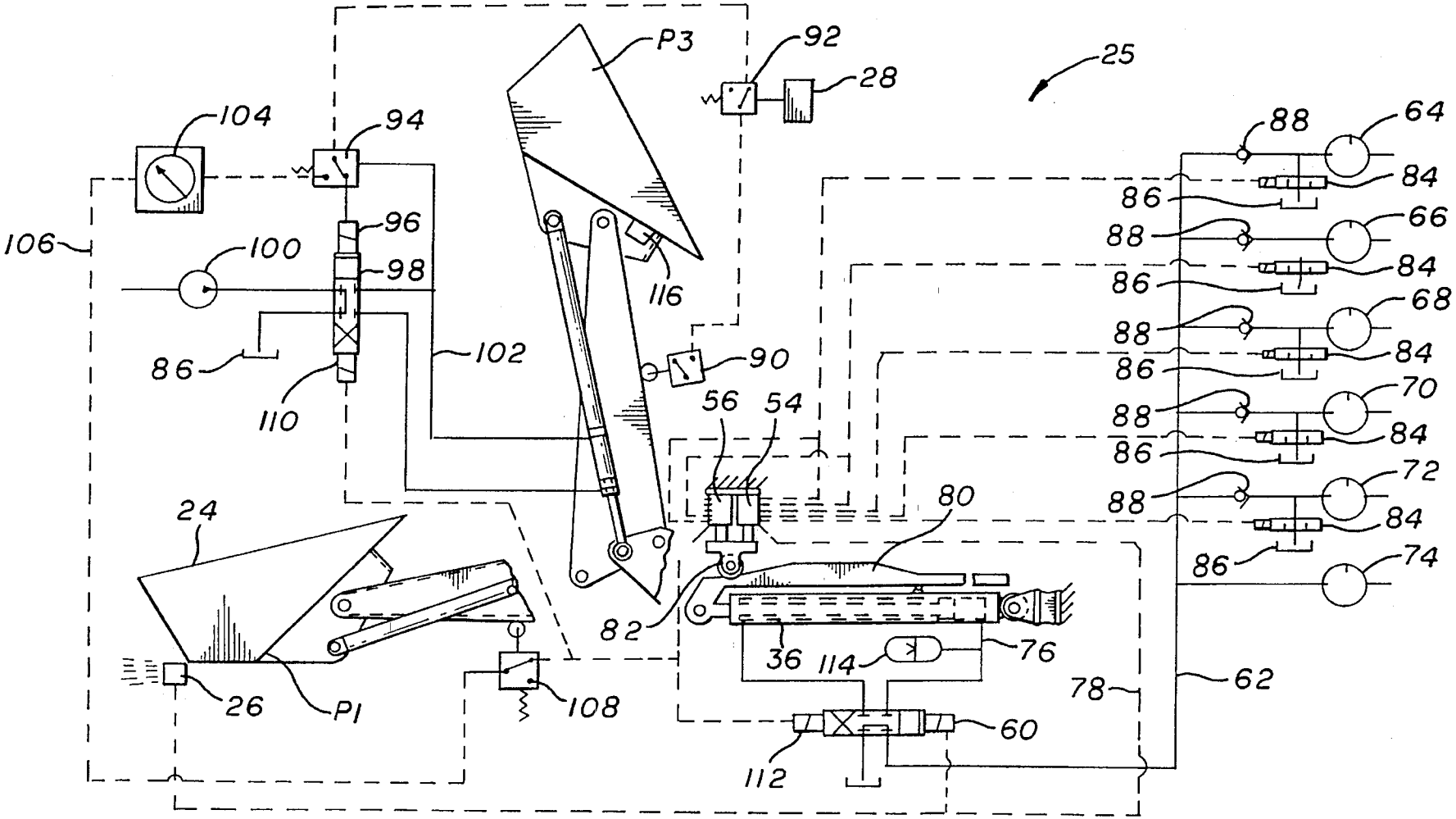
FIG. 6 is a schematic diagram of the control system made in accordance with the present invention.

FIG. 4 also shows the base 30 partially removed to show part of the control system which is utilized to regulate the pumps that are used in conjunction with the hydraulic cylinder to control the amount of fluid being pumped to the cylinder. A cam 50 is attached to the lift arm such that it rotates as the lift arm moves through the first position P1 to the second position P2. The cam 50, in turn is in contact with a cam roller 52 which activates a pair of five-stage electrical switches 54 and 56. In this manner, the control system operates in response to the lifting stroke of the main cylinder 38 as it moves the lift arm 32 through the respective positions. It should be appreciated that the cam 50 which is utilized in the embodiment disclosed herein is just one of a number of different cam following devices which could be utilized with the lift assembly of the skip hoist in order to control the pumping system of the entire system. FIG. 6 shows an alternative arrangement which could also be effectively used to control the hydraulic and electrical systems which make up the present invention. Still other means for activating the hydraulic and electrical systems via the positioning of the lift stroke of the hydraulic cylinder could be implemented without departing from the spirit and scope of the present invention.

Figure 5:
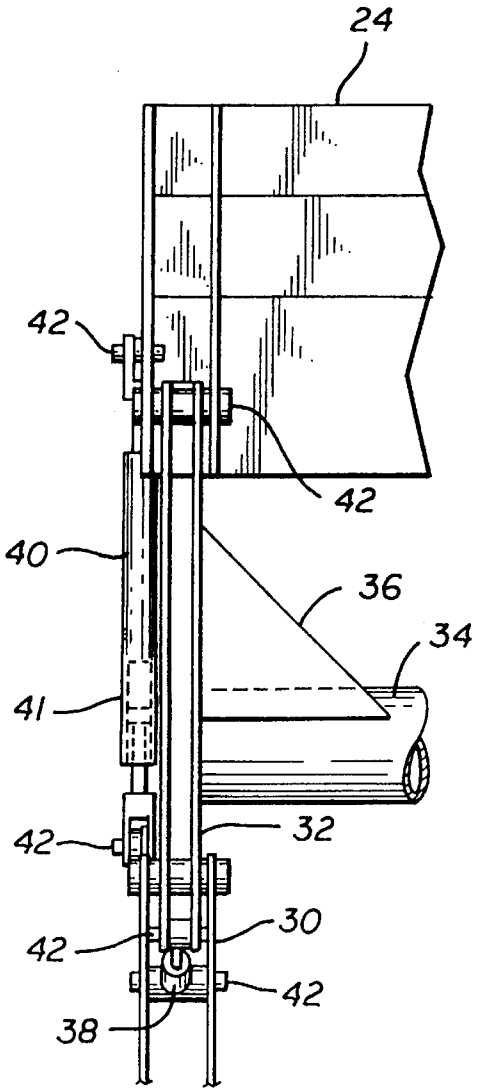
FIG. 5 is a partial side elevational view of the high speed skip hoist system shown in FIG. 2.

Referring now to FIG. 5, a partial side elevational view of the skip hoist system is shown which includes the bucket 24 as it is attached to the lift arm 32 and the other components of the system. In this particular figure, the extendable link 40 with its hydraulic cylinder 41 is shown as it is attached to the outside portion of the bucket via pins 42. The opposite end of the hydraulic cylinder 41 is also attached to the base plate 30. The main hydraulic cylinder 38 is, of course, pivotally attached to both the base plate 30 and the lift arm 32 to provide the lifting power needed to raise the bucket from the first position P1 to the second elevated position P2. Again, pins 42 are utilized to attach the hydraulic cylinder along with the lift arms to the base plate 30 and bucket 24. FIG. 4 also shows the cylindrical support structure 34 which is attached to the lift arm 32 and the other lift arm (not shown) to provide structural stability to the lift assembly. An anchor plate 36 is also shown as it is welded to the piece for additional rigidity.

During the lift stroke, the bucket is raised from the first position P1 to the second position where it is held until the system signals the cylinder 41 to expand thus moving the bucket 24 into the third position P3, allowing the bulk material to fall into the hopper 16. The extendable link 40 is also pivotally attached to the base plate 30 and bucket 24 via pins 42. It should be appreciated that in the embodiment described herein, the extendable link 40 is shown as a substantially cylindrical piece attached to a hydraulic cylinder. Certainly, other means for moving the bucket from the second position P2 to the third position P3 could also be utilized without departing from the spirit and scope of the present invention.

Referring now to FIG. 6, the control system which is utilized to control the hydraulic and electrical components making up the present invention is illustrated in schematic representation. It should be appreciated that in FIG. 6, the bucket is shown schematically as it appears in the first position P1 and as it later appears in the third position P3. The second position P2 is not illustrated in this particular schematic, but will be addressed in the description herein.

As was discussed above, the sensor 26 is attached to the bucket 24 to detect the presence of the front end loader 22. This particular sensor 26 provides an electrical signal to actuate a main four-way valve 60 opening the hydraulic circuit 62 of a bank of five pumps 64, 66, 68, 70, and 72 arranged in series and a single pump 74 to the piston end 76 of the main hydraulic cylinder 36. A parallel electrical circuit 78 which is connected to the sensor 26 is also connected with a five-stage electrical switch 54 which is operated by the cam 80 against the cam roller 82 which in turn is operated by the stroke of the main cylinder 38. This particular cam 80 which is attached to the hydraulic cylinder, is an alternative means for controlling the system via the lift stroke of the hydraulic cylinder 36. Again, other means for controlling the system could be implemented without departing from the spirit and scope of the present invention.

Each of the hydraulic pumps, 64, 66, 68, 70, 72 and 74 has an electric solenoid dump valve 84 and a reservoir tank 86. Each electrical solenoid operated dump valve 84 is normally open to the reservoir tank 86 except when the solenoid is energized. When an electrical current is applied, the dump valves 84 successively close the connection to the reservoir tank 86 during the lift stroke of the cylinder 38. Each pump 64–74 thus provides additional hydraulic fluid flow volume to augment the total flow in a step-wise fashion. The secondary pump 74 provides a minimum flow to the hydraulic cylinder 36 and is without a dump valve 84. Check valves 88 prevent reverse flow to the reservoir tanks 86 when the valves 84 are open.

The control system thus provides increased fluid flow through the hydraulic cylinder from a minimum to a maximum to accelerate the motion of the lift and, at the end of the lift stroke, begins a similar deceleration before the hydraulic cylinder comes to the end of its lift stroke. Thus, by carefully controlling the amount of hydraulic fluid being pumped to the hydraulic cylinder, the speed of the payload in the bucket can be strictly controlled so that force moments are not generated which would require considerable braking forces in order to stop the momentum of the bucket as it nears the end of its lift stroke. The ends of the lift stroke of the hydraulic cylinder are also provided with cushions normal to hydraulic cylinder construction as well.

When the lift arms 32 reach their elevated position at the second elevated position P2, and travel of the main cylinder 38 has come to a stop, an electrical limit switch 90 is actuated. This limit switch 90 is connected in series with a hydraulic pressure sensor which is located on the weigh load cell 28 beneath the hopper 16 of the primary crushing station 12. If the load in the hopper 16 is too great, the pressure sensor switch 92 is opened and no current passes through the pressure sensor switch 92. If, on the other hand, current passes through the switch 92 and through switch 94, a current is provided to the electric solenoid 96 of a four-way valve 98 which then provides hydraulic flow from a pump 100 through line 102 to cylinders 41, causing the extendable link 40 to extend to the third position P3. The tilting of the bucket 24 from the second elevated position P2 to the third position P3 allows the materials from the bucket 24 to drop into the hopper 16.

The bottoming out of cylinder 41 is indicated by a pressure rise at the pressure switch 94. This opens the switch 94 thus releasing solenoid 96 allowing the four-way valve 98 to spring center itself and close the cylinder ports of valve 98 so that the bucket 24 is held in the third position P3. At the same time, an adjustable electric timer 104 is actuated which could also actuate a vibrator 116 which can be placed on the bucket 24 and which, after a set time disconnects and provides an electrical signal through conductor 106 to cause the simultaneous actuation of both four way hydraulic valves 60 and 98 to cause the retraction of the main cylinder 36 and cylinder 41 to allow the return of the bucket 24 to the first position P1.

During the retraction of the bucket from the second position P2 and third position P3 back to the first position P1, the total flow may be limited by a second five-stage electrical switch 56 operated by the cam 80 and cam roller 82. The connection of the switch will engage fewer pumps for the downwards stroke because of the reduced volume of the fluid at the rod end of the hydraulic cylinder 38.

During the course of loading the bulk material from the front end loader to the bucket 24, a substantial amount of shock could be generated on the system depending on how the operator discharges the load from his loader into the bucket 24. Several approaches can be utilized to accommodate for this shock. One is the shock absorbing means 48 which is shown in FIG. 4. This provides some relief to the system from the generation of the shock forces to the lift arm assembly.

Another way to compensate for the shock is to utilize a limit switch 108 which is set to open at the lower most normal position of the lift arm 32. When this switch 108 is opened, solenoids 110 and 112 are de-energized and the four-way valves become spring centered. The piston ends of the cylinder 36 can be connected to a spring or gas charge accumulator 114. Thus, when a load is dropped into the bucket 24 causing an excessive shock load, the hydraulic fluid contained in the piston ends of the main cylinder 36 could momentarily escape into the accumulator 114, compressing the gas charge therein. These accumulators 114 are off the shelf items and include a check valve to restrict their return rate of hydraulic fluid to avoid "bouncing." The gas charge pressure of the accumulators would enable lifting the maximum load with minimal escape of hydraulic fluid into the accumulator 114. The accumulator would also tend to "soften" the engagement of the several pumps as each pump is added or deleted from the circuit during the acceleration or deceleration modes.

Often, sticky materials such as clays may be present which is oftentimes difficult to remove from the bucket 24. As an option, an electric or pneumatic vibrator 116 could be attached to bucket 24 and connected with the electrical system to allow it to operate during the time the bucket is at the third position P3.

The time duration of the automatic cycle utilized in accordance with the control system of the present invention can be varied according to the necessary working parameters at the job site. Additionally, the number of pumps, which are utilized with the present hydraulic system could be varied to use more or less pumps depending upon the desired operational characteristics which may be needed. The components which make up the control system of the present invention can be obtained commercially as they are known components in the art. The lift arm assembly including the buckets and hydraulic cylinders are known in the art and are commercially available. The base, lift arms and bucket can be manufactured from structural steel or other similar suitable material. The hydraulic cylinder must of course be properly sized to handle the payload which will be lifted by the skip hoist system.

It should be appreciated that while the volume rate from the pump(s) should be controlled to regulate the acceleration and deceleration forces, it is possible to utilize other pump systems, besides the multiple pump configuration shown and described herein, to achieve the same result. For example, a variable swash plate could be controlled by a cam similar to the cam 80 shown and described above to achieve similar control of the hydraulic system still other means for controlling a single pump could possibly be used to achieve similar results.

From the above, it is evident that the present invention provides a novel skip hoist system for elevating a heavy payload from a first position to a second elevated position while strictly controlling the acceleration and deceleration of the payload as it moves rotationally from the first to second position. While particular forms of the invention have been described and illustrated, it will be apparent to those skilled in the art that various modifications may be made without departing from the spirit and scope of this invention. Accordingly, it is not intended that the invention be limited, except by the appended claims.

What is claimed is:

1. A high speed skip hoist system for supplying a primary crusher with a payload of bulk solids, comprising:

a bucket for receiving the payload of bulk solids;

means for moving the payload of bulk solids within said bucket between a first position and a second elevated position through substantially rotational motion, said moving means including at least one hydraulic cylinder for providing a lifting stroke for rotationally moving the payload between the first and second elevated positions;

means for controlling the discharge of the payload of bulk solids onto the primary crusher while the bucket is in substantially the second position;

pump means operatively connected with said hydraulic cylinder for actuating said hydraulic cylinder; and control means for controlling said pump means for regulating the acceleration and deceleration of the payload as it moves rotationally between the first and second elevated positions, wherein said control means is operative in response to the lifting stroke of said hydraulic cylinder.

2. The high speed skip hoist system as defined in claim 1 further including means for preventing spillage of the contents during rotational travel between the first and second positions.

3. The high speed skip hoist system as defined in claim 2 wherein said moving means includes:

a base; and a pair of lift arms pivotally attached to said base and said bucket, said hydraulic cylinder being pivotally attached to said base and one of said lift arms.

4. The high speed skip hoist system as defined in claim 3 wherein said means for preventing spillage of the payload includes at least one extendible link pivotally attached to said base and said bucket, said extendible link including a hydraulic cylinder for moving said bucket to a third position.

5. The high speed skip hoist system as defined in claim 1 wherein said control means for controlling said pump means regulates the flow rate of hydraulic fluid to said hydraulic cylinder when the payload is moved between the first and second elevated positions.

6. The high speed skip hoist system as defined in claim 5 further including means for sensing the presence of an external object adjacent the skip hoist system for activation of the control means.

7. The high speed skip hoist system as defined in claim 5 wherein said pump means includes a plurality of hydraulic pumps connected in series with said hydraulic cylinder and said control means includes means for regulating the amount of fluid from each of pumps in response to the lift stroke of said hydraulic cylinder.

8. The high speed skip hoist system as defined in claim 7 wherein each of said hydraulic pumps is designed to pump a particular amount of fluid to said hydraulic cylinder upon activation.

9. The high speed skip hoist system as defined in claim 8 wherein said control means is designed to decrease the amount of fluid being pumped to said hydraulic cylinder as the payload approached the second elevated position to decelerate the payload.

10. The high speed skip hoist system as defined in claim 9 wherein said control means includes means for dissipating external shock forces which may be applied to the skip hoist system.

11. The high speed skip hoist system as defined in claim 5 wherein said control means provides a timed cycle for moving the payload between said first and second positions.

12. The high speed skip hoist system as defined in claim 1 wherein said pump means includes a plurality of hydraulic pumps connected in a series with said hydraulic cylinder and wherein said control means regulates the amount of fluid from each of pumps in response to the lift stroke of said hydraulic cylinder.

13. The high speed skip hoist system as defined in claim 1 wherein the primary crusher includes a hopper for receiving the bulk solids and includes means for sensing the amount of bulk materials in the hopper, said control means being operatively connected with the sensing means of the primary crusher to control the amount of bulk solids being discharged into the hopper.

14. A high speed skip hoist system for supplying a primary crusher with a payload of bulk solids, comprising:

a bucket for receiving the payload of bulk solids;

means for moving the payload of bulk solids within said bucket between a first position and a second elevated position through substantially rotational motion, said moving means including at least one hydraulic cylinder for providing a lifting stroke for rotationally moving the payload between the first and second elevated positions;

means for moving said bucket to a third position to discharge the payload of bulk solids into the primary crusher;

pump means operatively connected with said hydraulic cylinder for actuating said hydraulic cylinder; and means for controlling said pump means for regulating the acceleration and deceleration of the payload as it moves rotationally between the first and second elevated positions, wherein said control means is operative in response to the lifting stroke of said hydraulic cylinder.

15. The high speed skip hoist system as defined in claim 14 wherein said means for controlling said pump means regulates the flow rate of hydraulic fluid to said hydraulic cylinder when the payload is moved between the first and second elevated positions.

16. The high speed skip hoist system as defined in claim 14 wherein the primary crusher includes a hopper for receiving the bulk solids and includes means for sensing the amount of bulk materials in the hopper, the system including control means operatively connected with the sensing means of the primary crusher to control the amount of bulk solids being discharged into the hopper.

* * * * *